US005350901A

United States Patent [19]

Iguchi et al.

[11] Patent Number: 5,350,901

[45] Date of Patent: Sep. 27, 1994

[54] ELECTROMAGNETIC INDUCTION STEAM GENERATOR

[75] Inventors: Atsushi Iguchi; Kuniaki Iguchi, both of Kyoto, Japan

[73] Assignees: Nikko Corporation Ltd., Kyoto; Senko Denki Corporation Ltd., Kyoto, Japan

[21] Appl. No.: 4,118

[22] Filed: Jan. 13, 1993

[30] Foreign Application Priority Data

Jul. 27, 1992 [JP] Japan ..... 4-200032
Oct. 21, 1992 [JP] Japan ..... 4-282739

[51] Int. Cl.[5] ..... H05B 6/10

[52] U.S. Cl. ..... 219/630; 219/667; 219/670

[58] Field of Search ..... 219/10.51, 10.65, 10.75, 219/10.491, 10.79, 628, 629, 630, 667, 670

[56] References Cited

U.S. PATENT DOCUMENTS

| | | | |
|---|---|---|---|
| 1,653,014 | 12/1927 | Kittredge et al. . | |
| 1,882,573 | 10/1932 | Hammers et al. . | |
| 2,501,393 | 3/1950 | Kendall | 219/10.51 |
| 2,622,184 | 12/1952 | Johneas | 219/10.51 |
| 3,388,230 | 6/1968 | Cunningham et al. | 219/10.51 |
| 3,435,170 | 3/1969 | Smith | 219/10.65 |
| 4,311,896 | 1/1982 | Junya | 219/10.75 |
| 4,560,849 | 12/1985 | Migliori et al. | 219/10.51 |
| 4,708,325 | 11/1987 | Georges | 219/10.79 |
| 4,856,097 | 8/1989 | Mohr | 219/10.75 |

FOREIGN PATENT DOCUMENTS

| | | |
|---|---|---|
| 1135526 | 4/1957 | France . |
| 2-291694 | 12/1990 | Japan . |
| 136900 | 1/1920 | United Kingdom . |
| 1100167 | 1/1968 | United Kingdom . |

OTHER PUBLICATIONS

European Search Report dated Oct. 19, 1993.

*Primary Examiner*—Philip H. Leung
*Attorney, Agent, or Firm*—Fish & Richardson

[57] ABSTRACT

An electromagnetic induction steam generator is compact or ultra-compact and highly efficient, and capable of continuous operation, intermittent operation and empty-heating operation. Magnetic flux passes through a closed magnetic circuit of two leg iron cores, a heater, and a yoke iron core after a low-frequency alternating current is supplied from a power supply to electric wire coils. Joule heat is generated inside the heater by the permeation of magnetic flux. When fluid such as water, is supplied from the fluid supply port, it is heated and becomes steam within the heating chamber. The steam then emerges from the steam output port.

9 Claims, 8 Drawing Sheets

ELECTROMAGNETIC INDUCTION STEAM GENERATOR

FIELD OF THE PRESENT INVENTION

This invention relates to an electromagnetic induction steam generator which operates with a low-frequency alternating current electric power source. More specifically, this invention relates to an electromagnetic induction steam generator which is compact and highly efficient being capable of continuous operation, intermittent operation and empty-heating operation.

BACKGROUND OF THE INVENTION

Steamers in current use, such as cooking steamers, convection ovens, cooking steam warmers, steamers for defrosting frozen food, steamers for processing tea leaves, steam baths for household use, steamers for cleaning, and steamers used in restaurants and hotels, are widely used as equipment for utilizing the steam they generate.

Generally, fossil fuels (gas, petroleum, crude petroleum, coal and so forth) are burned as heat sources for large steamers in current use. This heating method, however, is not economical for compact steamers.

Relatively compact steamers in current use commonly employ electrical resistance heaters as a heat source. Such steamers obtain steam intermittently by spraying water on an iron plate which has been heated in advance with a heater or the heater's protecting tube from inside or beneath the plate. Another method involves the use of a vertical electromagnetic induction heater, which has been disclosed by this inventor (Japanese Patent Application Laid-Open No. 291,694/1990 and EPC No. 0380030A1).

However, the steamers using electrical resistance heaters as a heat source cannot be used continuously. A problem originates with the structure of the electrical resistance heater: the circumference of resistance heaters such as nichrome resistance wire heaters (the heat source) are filled with an insulator such as magnesium oxide, and the outside of the heater is surrounded by a protecting tube; therefore, heat from the heat source is indirectly promoted, and the heat cannot be promptly supplied to thermal exchanges occuring outside the protecting tube.

A further problem with the steamers utilizing electrical resistance heaters is that they cannot be used for long periods. Because of the indirect heating method, when spraying water on an iron plate after heating the protecting tube throughly, the temperature difference ($\Delta T$) between the surface of the protecting tube and evaporating surface (which is 100° C. under normal pressure) can be as high as several hundred degrees; therefore, mineral elements in water, mainly calcium, are likely to stick to the evaporating surface as scale. Scale lowers the coefficient of heat transmission tremendously and leads to the enhancement of the $\Delta T$. Thus, a problem exists in that resistance heaters such as nichrome resistance wire heaters are eventually burned off. Therefore, an electrical resistance heater is not suitable for compact or ultra-compact steamers.

Additionally, the vertical electromagnetic induction heater (Japanese Patent Application Laid-Open No. 291,694/1990 and EPC No. 0380030A1) presents a problem in that the heater, which comprises at least six electromagnetic induction coils, is not appropriate for compact or ultra-compact steamers, although it is excellent for medium-sized steamers and is widely used.

SUMMARY OF THE INVENTION

It is an objective of this invention to provide an electromagnetic induction steam generator which solves the above-noted problems, is compact or ultra-compact and highly efficient, is capable of continuous operation, intermittent operation and empty-heating operation, and uses an alternating current power source.

In order to accomplish the above objectives, this invention includes an electromagnetic induction steam generator which operates with at least two leg iron cores wrapped by electric wires to form a coil around each core, the coil supplying a low-frequency alternating current, a closed magnetic circuit connecting the inner side of each leg iron core, at least one part of the closed magnetic circuit being a heater made of a metallic material which can be heated by Joule heat, wherein the heater has a fluid supply port and a steam output port, and the heater has a hollow chamber in its central portion, wherein steam is produced.

It is preferable in this invention that a part of the closed magnetic circuit connecting each end of at least two leg iron cores is a yoke iron core.

It is preferable in this invention that the parts of the closed magnetic circuit connecting the inner sides of at least two leg iron cores are both heaters.

It is preferable in this invention that the two heaters are linked by a connecting hose.

It is preferable in this invention that the hollow chamber inside the heater employs a gas-liquid separator.

It is preferable in this invention that the leg iron cores comprise wound cores.

It is preferable in this invention that the fluid supply port is connected to a base of the heater while the steam output port is connected to a cover of the heater.

It is preferable in this invention that the temperature detecting terminal is connected to the metallic material, and is also connected to a temperature control unit.

It is preferable in this invention that the hollow chamber of the heater is located in a flow path of magnetic flux.

It is preferable in this invention that the electromagnetic steam generator comprises means to operate at a low-frequency alternating current of 50 Hz or 60 Hz.

In accordance with this invention, a magnetic flux flows in the closed magnetic circuit including the leg iron cores as a low-frequency alternating current power source is supplied to coils wrapped around at least two leg iron cores. The heating element is made of a material which can be permeated by magnetic flux; therefore, Joule heat is generated in a heater due to the permeation. Therefore, steam is generated inside the chamber of the heater and flows out the steam output port when liquid such as water is supplied from the fluid supply port. As a result, this electromagnetic induction steam generator can be compact or ultra-compact and is highly efficient and capable of continuous operation, intermittent operation and empty-heating operation by employing an alternating current power source.

Additionally, in the embodiment of this invention whereby a heating element is flanked by two leg iron cores, a steamer can be compact or ultra-compact without requiring extra space. Additionally, a temperature sensor can be easily inserted into the metallic material inside a heater, resulting in proper temperature control.

It is preferable in this invention that, in a steamer having one heating element, a part of the closed magnetic circuit connecting each end of at least two leg iron cores is a yoke iron core.

It is preferable in this invention that, in a steamer having two heating elements, parts of the closed magnetic circuit connecting the inner side of at lest two leg iron cores are both heating elements.

It is preferable in the composition of the steamer having two heating elements that the elements are linked by a connecting hose in order to obtain what is called dry steam by enhancing the gas-liquid separation operation.

It is preferable in this invention that the hollow chamber inside the heater is equipped with a means to increase the gas-liquid separation operation and create dry steam.

It is preferable in this invention that the leg iron cores are composed of wound cores to make the apparatus more compact and to reduce its cost.

It is preferable in this invention that a fluid supply port is connected to the bottom of the heater, and a steam output port is connected to the top of the heater to maintain a unidirectional flow of fluid.

It is preferable in this invention that a temperature detecting terminal is joined to the metallic part of the heater and linked to a temperature control unit to control temperature properly.

It is preferable in this invention that the hollow chamber of the heater, in which steam is created, is located in the flow path of magnetic flux to heat both the liquid and gas phases of fluid efficiently.

It is preferable in this invention that a low-frequency alternating current of 50 Hz or 60 Hz is used to keep the apparatus cost low and control temperature properly.

BRIEF DESCRIPTION OF THE DRAWINGS

This invention will now be described in detail with reference to the following drawings.

DETAILED DESCRIPTION OF THE INVENTION

Figure 1:
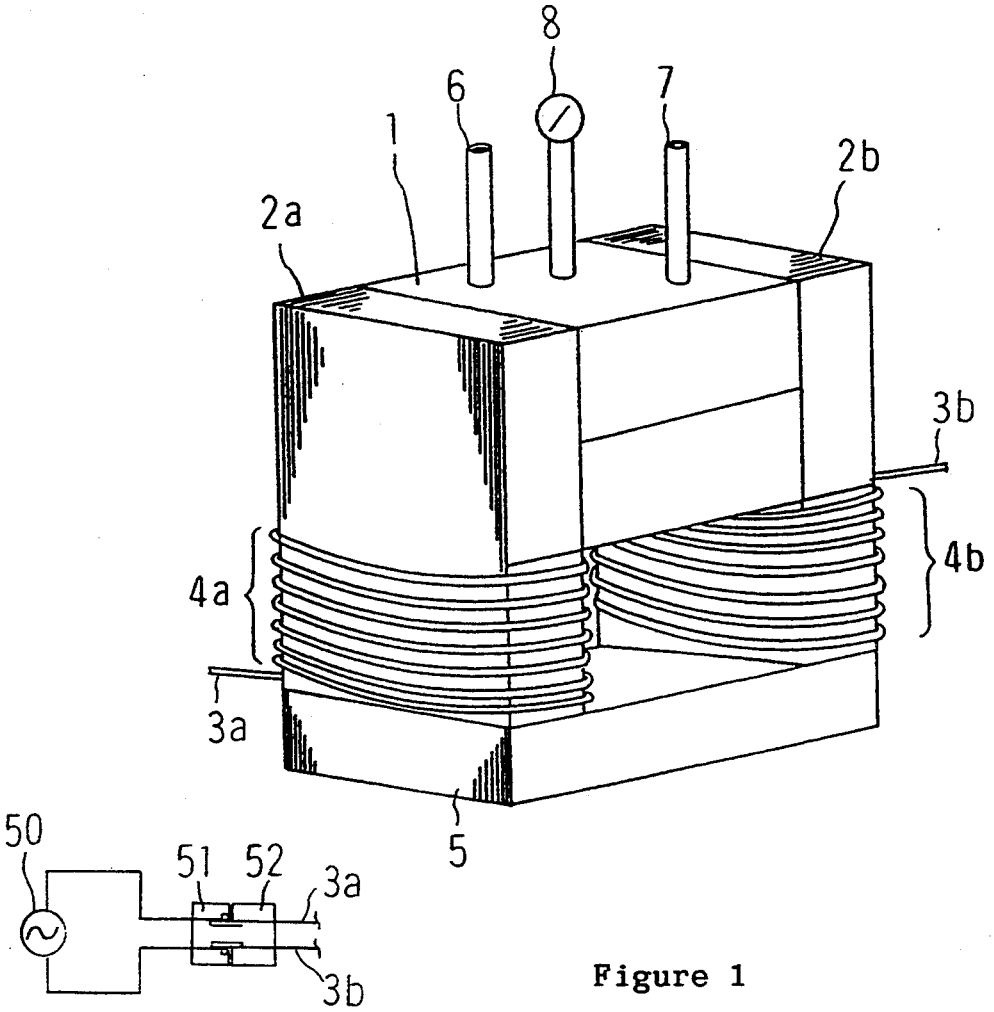
FIG. 1 shows a perspective view of one embodiment of an electromagnetic induction steam generator of this invention.

FIG. 1 shows a perspective view of an embodiment of an electromagnetic induction steam generator of this invention. Heater 1, leg iron cores 2*a* and 2*b*, coils 4*a* and 4*b* wrapped by electric wire 3, yoke iron core 5, fluid supply port 6, steam output port 7 and relief valve 8 are shown in FIG. 1. It is preferable in this invention that heater 1 is flanked by leg iron cores 2*a* and 2*b*. Heater 1 and the leg iron cores are joined together by means such as bolts and nuts. Heater 1 is made of a metallic material which can generate Joule heat due to the permeation of magnetic flux. It is preferable that this metallic material permits magnetic flux permeation and resists corrosion. Ferritic stainless steel (SUS-410), for example, is a preferable material. Iron can also be used, but it is preferable that the surface of the heater exposed to water is coated with an anticorrosive material. A low-frequency alternating current power source is supplied to the electric wire 3. It is preferable that the power source is, for example, 50 Hz or 60 Hz in the commercial frequency range. The power source can be either single-phase alternating current or three-phase alternating current. Also, silicon steel plate or an amorphous alloy can be used for the leg iron cores. It is preferable that the magnetic flux density of said cores is less than two teslas.

Figure 2:
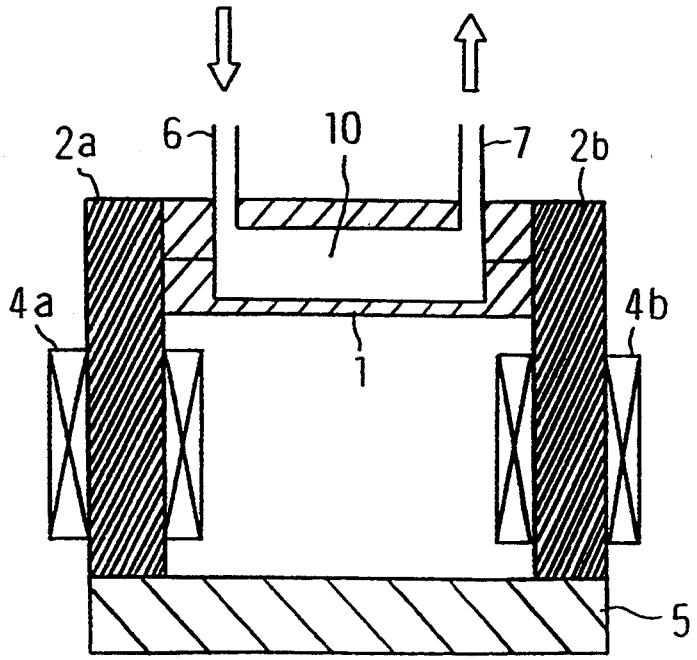
FIG. 2 shows a cross sectional view of the same example.
Figure 3:
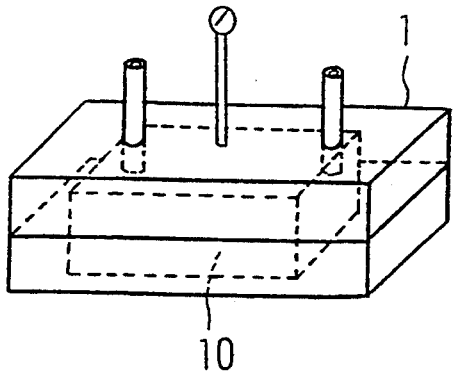
FIG. 3 shows a fragmentary perspective view of the heater of the same example.
Figure 5:
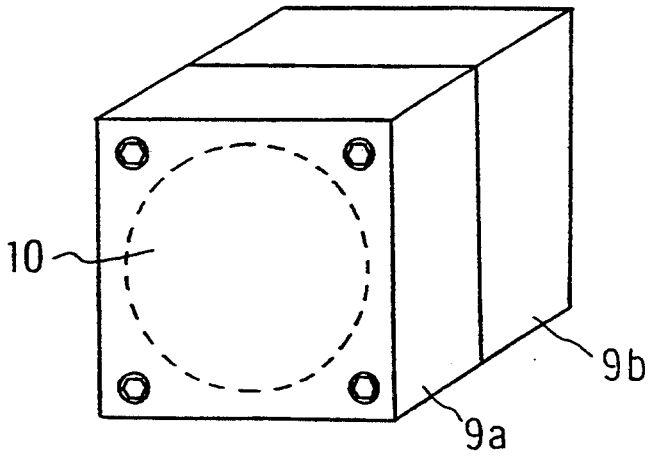
FIG. 5 shows a perspective view of the heater half shown in FIG. 4 joined with its other half.
Figure 6:
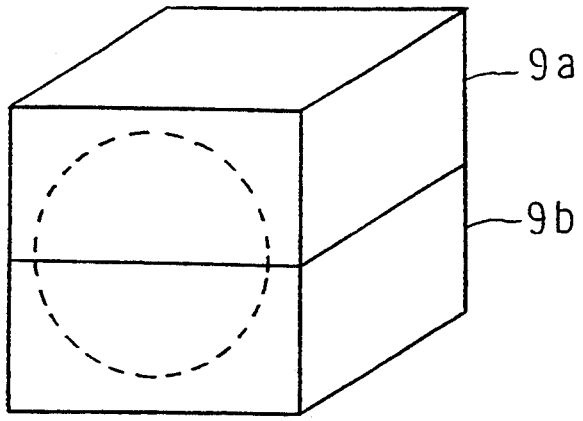
FIG. 6 shows a perspective view of another configuration of the heater shown in FIG. 5.

FIG. 2 shows a cross sectional view of FIG. 1. Chamber 10 is located inside heater 1, generating steam. Chamber 10 can be of any shape; it can be square like FIG. 3 or spheroidal like FIG. 5, by combining two heater halves such as semi-spheroids 9*a* and 9*b*, forming a spheroidal chamber 10 in FIG. 5. Moreover, the method of arranging heater halves 9*a* and 9*b* can be vertically as in FIG. 5 or horizontally as in FIG. 6. The gas-liquid separation operation (for instance, utilizing a thin, stainless steel baffle plate) can be employed anywhere inside the chamber.

In the above configuration of the apparatus, magnetic flux passes through the closed magnetic circuit composed of two leg iron cores 2*a* and 2*b*, the heater 1 and the yoke iron core 5 after a low-frequency alternating current is supplied from the single phase current power source 50 and through the electrical outlet 51, the plug 52 and the electric wires 3*a* and 3*b* to the coils 4*a* and 4*b*. Joule heat is thus generated inside heater 1 due to the permeation of magnetic flux. Therefore, when fluid such as water is supplied from the fluid supply port 6, it is heated and becomes steam within chamber 10. The steam thus emerges from the steam output port 7.

In this invention, as explained above, an electromagnetic induction steam generator is compact or ultra-compact and highly efficient being capable of continuous operation, intermittent operation, and empty-heating operation by using a commercial frequency electric current. (The empty-heating operation means that the heater of this invention will not cease operating or be burnt even after its water supply is consumed.) The steamer is also excellent in controlling temperature and is reliable for long-term operation. As an apparatus for generating a small volume of steam (such as 1–5 liters/hr), the steamer is ideal and very useful. The steamer is also portable and its heater is an effective energy saver. Furthermore, in this invention the heater exhibits excellent thermal efficiency, demonstrating at least 70% thermal efficiency and more than 80% with sufficient insulation.

This invention will now be illustrated specifically with reference to the following examples:

EXAMPLE 1

Figure 4:
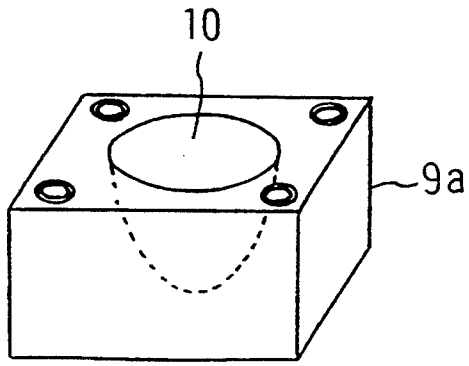
FIG. 4 shows a fragmentary perspective view of half of the heater of another embodiment of this invention.

Heater 1, having 160 mm length, 160 mm width and 80 mm height, is made of stainless steel (SUS-410), and has a spheroidal chamber 10 of 40 mm radius as in FIG. 4. Two halves are joined together by bolts to form a chamber as in FIG. 5. Copper packing is used between the two halves as a sealant. Leg iron cores 2*a* and 2*b*, having 160 mm width, 210 mm height and 35 mm thickness, are made of layers of a silicon steel plate of 0.35 mm thickness, said cores being connected to heater 1 by bolts. The yoke iron core, having 160 mm width, 230 mm length and 35 mm thickness, is also made of layers of a silicon steel plate of 0.35 mm thickness. When completely assembled as in FIG. 1 and supplied with 2.14 kwH (effective electric power) with a single phase alternating current (60 Hz) and 200 V electric power, 2.44 liters/hr of water steam at 110° C. (with a liquid water equivalency at 25° C.) was created. A temperature sensor was inseted into the stainless steel chamber of heater 1, and when the temperature was controlled at 194° C., thermal efficiency—the efficiency of changing electric power into heat—attained 81%. This result shows that the heater's thermal efficiency is quite high. This heater, of course, could also operate continuously for 24 hours, and could perform intermittent operation and empty-heating operation.

EXAMPLE 2

Figure 7:
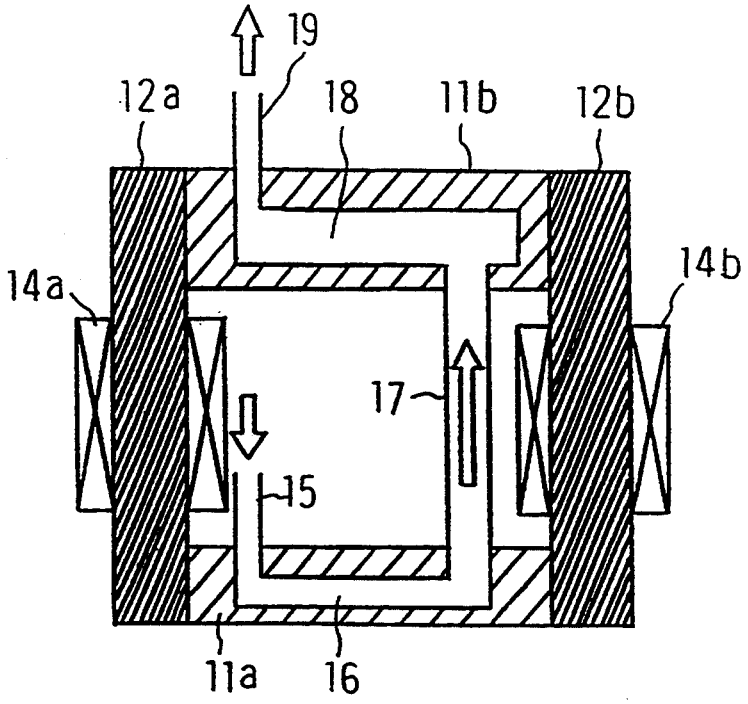
FIG. 7 shows a cross sectional view of a two-stage serial heater, still another embodiment of a heater of this invention.

FIG. 7 shows a cross sectional view of another embodiment of this invention. In this configuration, parts of the closed magnetic circuit connecting the inner sides of each of the iron cores 12*a* and 12*b* are both heaters 11*a* and 11*b*. Said heaters are flanked by leg iron cores 12*a* and 12*b*. 14*a* and 14*b* are coils. Heaters 11*a* and 11*b* are either isolated (not shown in figures) or linked by a connecting hose 17. When fluid such as water is supplied from the fluid supply port 15 connected to heater 11*a*, it is heated to produce steam in chamber 16. The steam travels up connecting hose 17, and is again heated in chamber 18 of heater 11*b*. The re-heated steam then emerges from steam output port 19. This two-stage serial heater can promote gas-liquid separation efficiently since its two heating elements are connected in series.

EXAMPLE 3

Figure 8:
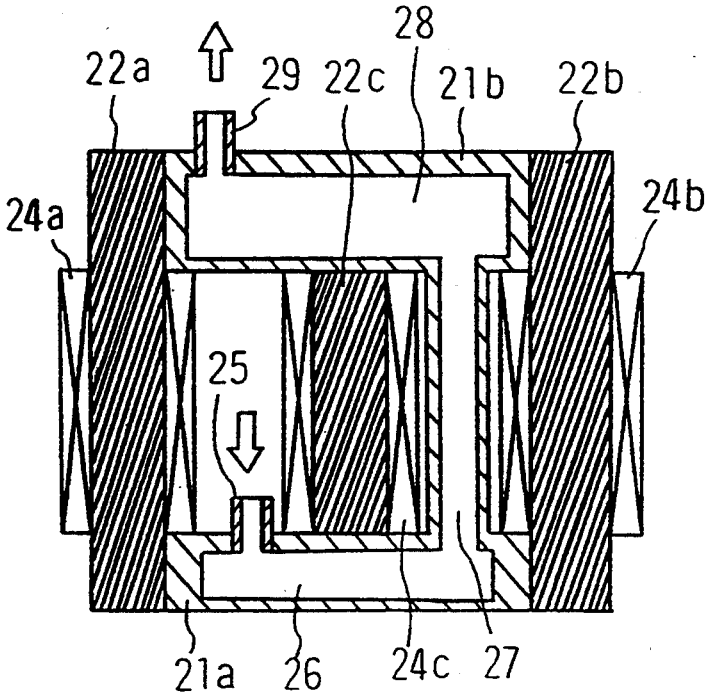
FIG. 8 shows a cross sectional view of a heater using a three-phase alternating current power source which is still another embodiment of this invention.

FIG. 8 shows a cross sectional view of still another embodiment of an electromagnetic induction steam generator of this invention. Heaters 21*a* and 21*b* are flanked by two leg iron cores 22*a* and 22*b*. In addition, a third leg iron core 22*c* is located between leg iron cores 22*a* and 22*b*. 24*a*, 24*b* and 24*c* are coils—a useful way of employing a three-phase alternating current power source. Heaters 21*a* and 21*b* are either isolated (not shown in figures) or linked by a connecting hose 27. When fluid such as water is supplied from the fluid supply port 25 of heater 21*a*, it is heated to produce steam in chamber 26. The steam then travels up connecting hose 27, and is again heated in chamber 28 of heater 2*b*. The re-heated steam then emerges from steam output port 29. This type of heater can promote gas-liquid separation quite efficiently since its two heating elements are connected in series.

EXAMPLE 4

Figure 9:
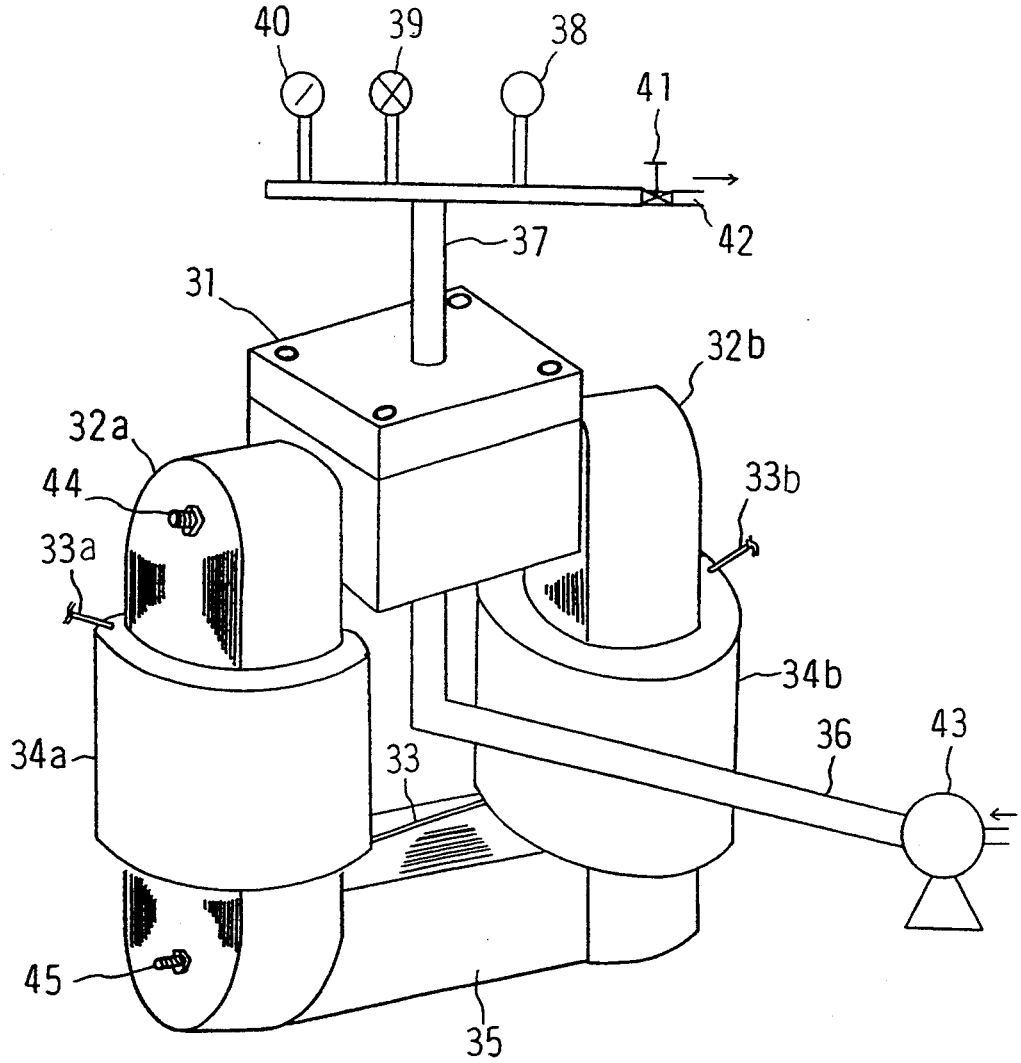
FIG. 9 shows a perspective view of an electromagnetic induction steam generator with fluid supplied to the bottom of the heater, which is still another embodiment of this invention.
Figure 9:
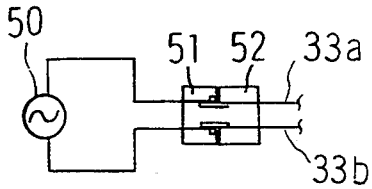
Figure 10:
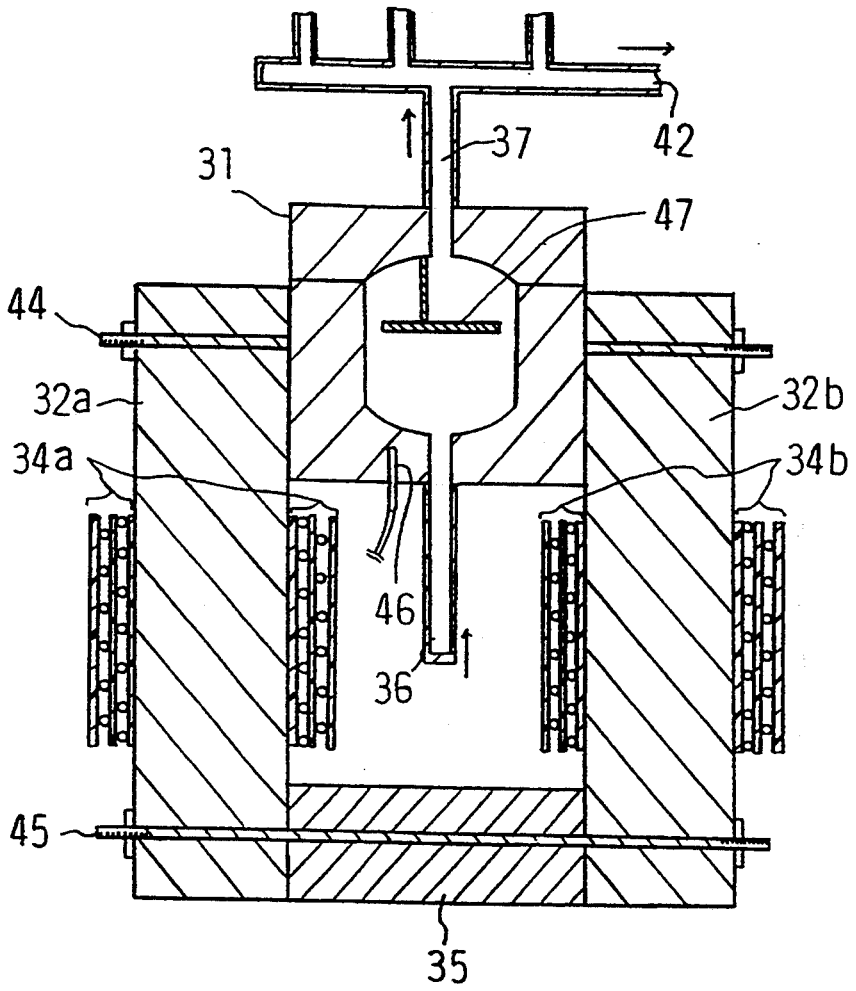
FIG. 10 shows a cross sectional view of the steamer shown in FIG. 9.

FIG. 9 shows a perspective view of still another embodiment of an electromagnetic induction steam generator of this invention, and FIG. 10 shows a cross sectional view of FIG. 9. In FIG. 9 and FIG. 10, a heating block 31 having 140 mm width, 140 mm length and 65 mm height is made of stainless steel (SUS-410). This heating block 31 is composed of a base having 50 mm height and a cover having 15 mm height, and copper packing is used as a sealant between the base and cover. The base and cover are joined together by bolts. The heating block contains a spheroidal chamber (100 mm diameter and 30 mm height) where steam is generated. Wound cores, each of which has 160 mm width, 210 mm height and 35 mm thickness, being made of layers of a silicon steel plate with 0.35 mm thickness, are used for leg iron cores 32*a* and 32*b*. Said leg iron cores are connected to heating block 31 by bolts 44 and 45 with accompanying nuts. 33, 33*a* and 33*b* are electric wires, and 34*a* and 34*b* are coils. As indicated in FIG. 10, an electric wire is wrapped about an insulating sheet for coils 34*a* and 34*b*. In a two-stage or multi-stage electric wire wrapping, an insulating sheet is inserted between each stage. 35 is a yoke iron core. 36 is a water supply pipe connected to the base of heating block 31, and 43 is a water supply pump. Water supplied from water supply pipe 36 is heated in the chamber of heating block 31, turning into steam. The steam is then separated to a gaseous body by separator 47, passing through steam output port 37 and emerging from exit port 42. 38 is a temperature sensor to control water supply, and is connected to a steam output line. 39 is a relief valve, and 40 is a manometer (pressure gauge). 41 is a pressure control valve to control steam outflow pressure. 46 is a temperature sensor inserted into heating block 31, connected to a temperature control unit, which controls the volume of electric power supplied to coils 34*a* and 34*b*.

50 is a single phase alternating current power source, and 51 is the electrical outlet of said power source. 52 is a plug, directly or indirectly connected to said electric wires 33*a* and 33*b*.

Figure 11:
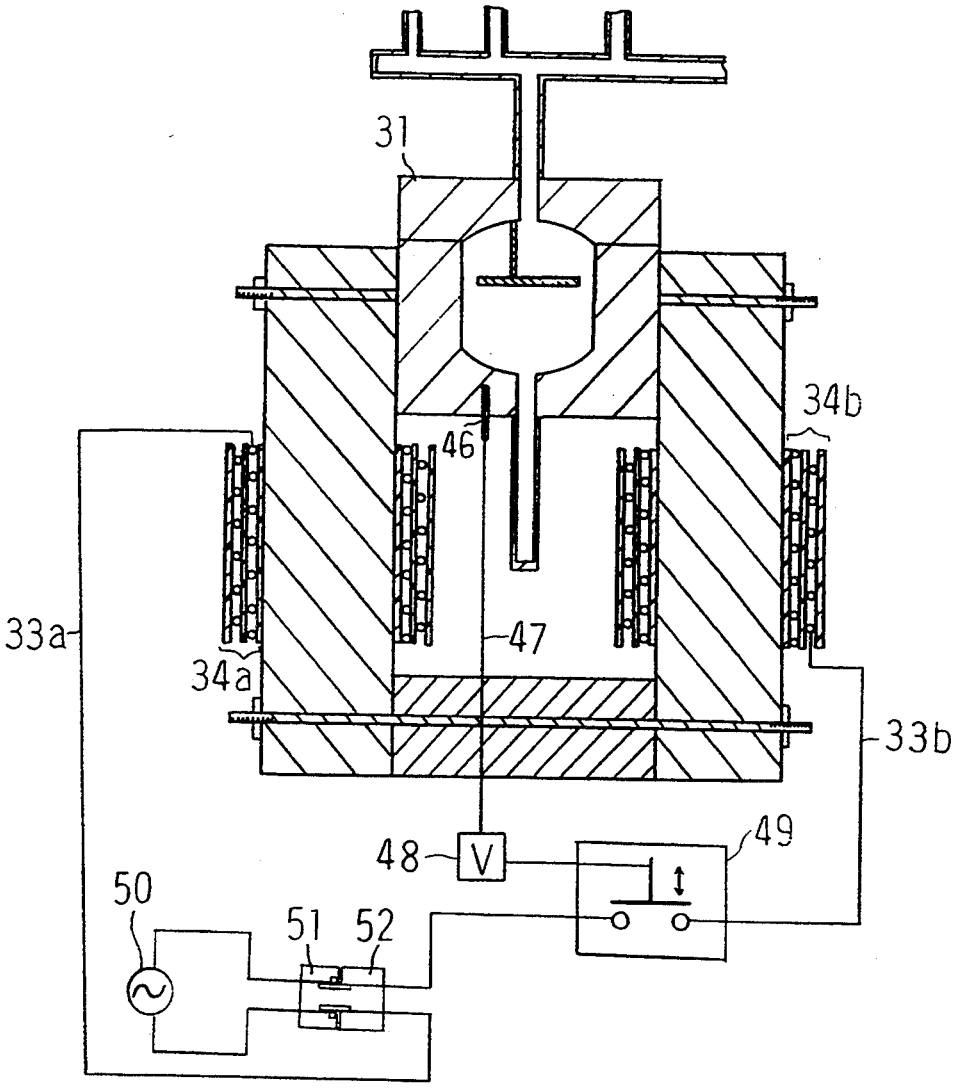
FIG. 11 shows a wiring diagram of a temperature control unit of one embodiment of this invention.

FIG. 11 shows one embodiment of an electric circuit to control temperature. The temperature sensor 46, inserted into the heating block 31, is connected to a temperature control gauge 48 by a connecting line 47. Mother connecting line, emerging from the temperature control gauge 48, is connected to a magnetic switch 49, thereby providing on-off control. In this fashion, temperature is controlled automatically. The temperature sensor can be also inserted as shown in FIG. 12, projected inside the chamber of the steam generator.

Figure 12:
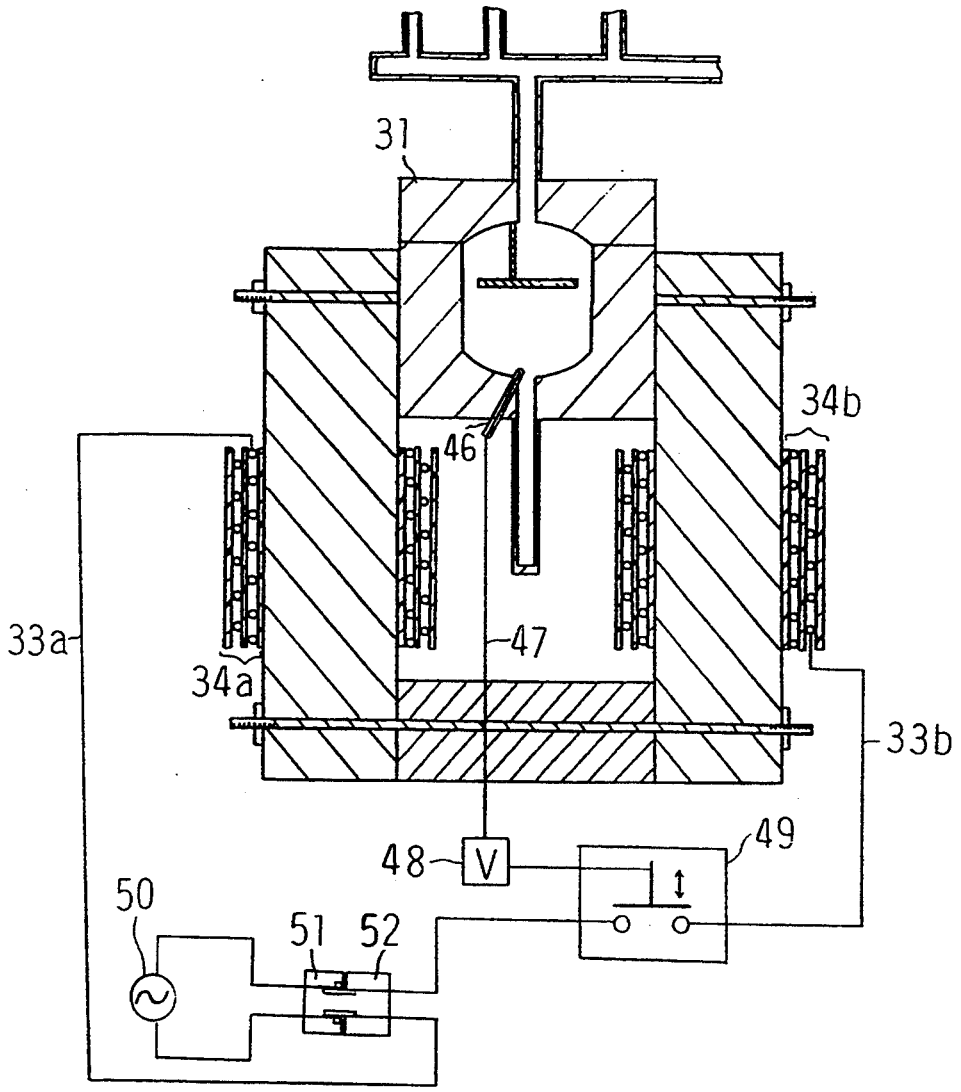
FIG. 12 shows a cross sectional view of another configuration of the temperature sensor shown in FIG. 12.

A generator, as shown in FIGS. 9–12, was supplied with 2.96 kwH (effective electric power) with a single phase alternating current (60 Hz) and 200 V electric power, and 3.38 liters/hr of water steam at 110° C. (with a liquid water equivalency at 25° C.) was produced. As shown in FIG. 11, a temperature sensor was inserted into the inner part of the stainless steel heating block 31. When the temperature was controlled at 194° C., the thermal efficiency—the efficiency of changing electric power into heat—attained 82%. This result shows that the heating block's thermal efficiency is quite high. This heating block, of course, could also operate continuously for 24 hours, and could perform intermittent operation and empty-heating operation. In case of temperature sensor 46 being projected inside the chamber of the steam generator as shown in FIG. 12, temperature could be suitably controlled from 100° C. to 150° C.

Moreover, the steam generator in this embodiment is quite compact. And due to the fact that the quantity of water supplied is small, the steam generator can be portable by providing a water supply tank; thus, the generator can be moved to where it is needed. The steam generator can prevent loss of heat when steam is passed through the steam output port, and can heat an object with a small volume of steam. In this sense, this steam generator can be quite efficient in saving energy.

As has been shown, the invention is greatly beneficial to industry.

The invention may be embodied in other specific forms without departing from the spirit or essential characteristics thereof. The present embodiment is to be considered in all respects as illustrative and not restrictive, the scope of the invention being indicated by the appended claims rather than by the foregoing description and all changes which come within the meaning and range of equivalency of the claims are intended to be embraced therein.

We claim:

1. An electromagnetic induction steam generator comprising:

at least two leg iron cores wrapped by electric wires to form a coil around each core, said coil receiving a low-frequency alternating current from a power supply connected to said electric wires;

and a closed magnetic circuit directly connecting the inner side of each said leg iron core, at least one part of said closed magnetic circuit being a heater made of a metallic material to permit flux permeation and to resist corrosion which can be heated by Joule heat, wherein said heater has a fluid supply port and a steam output port, and said heater has a hollow chamber in its central portion and uses a gas-liquid separator, wherein said heater is capable of producing steam from fluid supplied to said hollow chamber through said fluid supply port.

2. An electromagnetic induction steam generator as set forth in claim 1, wherein a part of said closed magnetic circuit connecting each end of at least two leg iron cores is a yoke iron core.

3. An electromagnetic induction steam generator as set forth in claim 1, wherein parts of said closed magnetic circuit connecting the inner sides of each leg iron core are heaters.

4. An electromagnetic induction steam generator as set forth in claim 3, wherein said heaters are linked by a connecting hose.

5. An electromagnetic induction steam generator as set forth in claim 1, wherein said leg iron cores comprise wound cores.

6. An electromagnetic induction steam generator as set forth in claim 1, wherein said fluid supply port is connected to a base of said heater and said steam output port is connected to a cover of said heater.

7. An electromagnetic induction steam generator as set forth in claim 1, wherein a temperature detecting terminal connected to the metallic material, and is also connected to a temperature control 8. An electromagnetic induction steam generator as set forth in claim 1, wherein said hallow chamber is located in a flow path of magnetic flux.

9. An electromagnetic induction steam generator as set forth in one of claims 4–8 further comprising means to operate at a low-frequency alternating current of 50 Hz or 60 Hz.

* * * * *